US007663468B2

(12) United States Patent
Mori et al.

(10) Patent No.: US 7,663,468 B2
(45) Date of Patent: Feb. 16, 2010

(54) CONDUCTIVE MEMBER AND MANUFACTURING METHOD THEREOF, AND ELECTRIC DEVICE AND MANUFACTURING METHOD THEREOF

(75) Inventors: Yukie Mori, Tokyo (JP); Nobuo Kobayashi, Tokyo (JP); Kenryo Namba, Tokyo (JP)

(73) Assignee: TDK Corporation, Tokyo (JP)

( * ) Notice: Subject to any disclaimer, the term of this patent is extended or adjusted under 35 U.S.C. 154(b) by 284 days.

(21) Appl. No.: 10/541,733

(22) PCT Filed: Jan. 16, 2004

(86) PCT No.: PCT/JP2004/000328

§ 371 (c)(1),
(2), (4) Date: Oct. 17, 2005

(87) PCT Pub. No.: WO2004/066321

PCT Pub. Date: Aug. 5, 2004

(65) Prior Publication Data

US 2006/0091992 A1 May 4, 2006

(30) Foreign Application Priority Data

Jan. 17, 2003 (JP) ..... 2003-010241

(51) Int. Cl.
*H01C 7/13* (2006.01)

(52) U.S. Cl. ..... 338/22 R

(58) Field of Classification Search ..... 338/22 R
See application file for complete search history.

(56) References Cited

U.S. PATENT DOCUMENTS 4,237,441 A 12/1980 Van Konynenburg et al.

(Continued)

FOREIGN PATENT DOCUMENTS

JP A-07-267618 10/1995

(Continued)

OTHER PUBLICATIONS

W. Krätschmer et al. "Solid $C_{60}$: a new form of carbon." *Nature International Weekly Journal of Science* vol. 347, No. 6291, Sep. 27, 1990, pp. 354-358.

(Continued)

*Primary Examiner*—Elvin G Enad
*Assistant Examiner*—Joselito Baisa
(74) *Attorney, Agent, or Firm*—Oliff & Berridge, PLC

(57) ABSTRACT

An electric device 1 is an organic positive thermistor in which, between two plate electrodes 2*a* and 2*b* constituting an electrode couple 2, a conductive member 41 is disposed in a state being in a close contact with the plate electrodes 2*a* and 2*b*. The conductive member 41 is formed of many piled up resin particles each having its surface formed with a conductive layer of a residual material (fullerene residual), which is the soot including fullerenes generated via, for example, an arc discharging method, from which at least a part of fullerenes is removed. Such conductive layers are joined to each other to structure the conductive path and the conduction of the electric device 1 is ensured in a normal state. When an inrush current flows, the conductive path is readily shut off by a small inflation of the resin particles due to the temperature rise.

6 Claims, 9 Drawing Sheets

U.S. PATENT DOCUMENTS

| | | | | |
|---|---|---|---|---|
| 6,495,290 | B1 * | 12/2002 | Hinokuma et al. | 429/231.8 |
| 2004/0048127 | A1 * | 3/2004 | Shirai et al. | 429/33 |

FOREIGN PATENT DOCUMENTS

| | | |
|---|---|---|
| JP | A 10-291814 | 11/1998 |
| JP | A 2000-082602 | 3/2000 |
| JP | A 2000-223303 | 8/2000 |
| JP | A 2000-269001 | 9/2000 |
| JP | A 2001-060501 | 3/2001 |
| JP | A 2001-085203 | 3/2001 |
| WO | WO 01/17900 A1 | 3/2001 |

OTHER PUBLICATIONS

J. B. Howard et al. "Fullerenes $C_{60}$ and $C_{70}$in flames." *Nature International Weekly Journal Of Science* vol. 352, No. 6331, Jul. 11, 1991, pp. 139-141.

* cited by examiner

CONDUCTIVE MEMBER AND MANUFACTURING METHOD THEREOF, AND ELECTRIC DEVICE AND MANUFACTURING METHOD THEREOF

TECHNICAL FIELD

The present invention relates to a conductive member and a manufacturing method thereof, and to an electric device and a manufacturing method thereof having the conductive member.

BACKGROUND ART

As an element or device, which has a characteristic such that the resistance value increases as the temperature rises (PTC characteristic), an organic positive thermistor is known. The organic positive thermistor is widely adopted as an element for an over current protection circuit, a self-control type heating element, a sensor element for temperature detection and the like.

Generally, the organic positive thermistor has such a structure that a conductive polymer, in which an electric conductor is dispersed in a resin and molded, is sandwiched by, for example, an electrode couple having a plate-like shape. As an example of such conductive polymer, a conductive polymer disclosed in the specification of U.S. Pat. No. 4,237,441, in which a specific amount of fine particles of carbon black as the electric conductor is mixed in a crystalline polymer as a matrix resin, is given.

In a load equipment or circuit to which an organic positive thermistor, in which such conductive polymer is employed, is connected, during operation in a normal state under appropriate temperature conditions, a steady-state current flows through the thermistor. This owes to the fact that the conduction is ensured by many fine particles, which are joined with each other, as the electric conductor included in the resin.

Contrarily, when there occurs an abnormality such as an operation under a non-normal state like overload etc or a short circuit within a device, an over current flows through the thermistor. In such a case, the conductive polymer is heated due to the over current. In the case where the polymer is a thermoplastic resin, it is conceivable that the resin is softened, melted, or fused resulting in an inflation in the volume of the resin. Accompanying this, the connection among the conductor particles is released and the conductive path is gradually cut off. Thus, the PTC characteristics are made to function.

Also, when a thermosetting resin is used as the polymer, when the temperature reaches to a deformation temperature of the resin or a glass-transition temperature due to the heat by the over current, the conductive path formed of many conductor particles is likewise cut off.

DISCLOSURE OF THE INVENTION

In the organic positive thermistor, the following characteristics are required. That is, the of resistance value at room temperature during non-operation should be satisfactorily low; the changes between the resistance value at room temperature and the resistance value during operation should be satisfactorily large; and the change of the resistance value due to the repeated operation should be small and the resistance value should be highly stable. In conventional thermistors utilizing a conductive polymer blended with fine particles of carbon black, the above various required characteristics are satisfied to a certain extent at the practical application level.

However, particularly, the thermistors, which are used, in the above described various applications, as the over current protection device, are further required the following characteristic. That is, in addition to the above characteristics, with respect to the changes in the intended operation ambient temperature, the operating current of the device should be constant. To meet this requirement, it is preferred that the resistance value increases extremely sharply as the temperature rises; i.e., in an extremely narrow operation temperature range (region), the resistance value is desired to change extremely largely. The above conventional thermistors utilizing the fine particles of carbon black fail in satisfying such requirements satisfactorily.

Also, when it is intended to cause the resistance value to change sharply within such a narrow temperature range, the following problems may occur. That is, in addition to an earlier deterioration of the product due to the repeated operation, operating current value (range) may readily differ among the products. In such case, disadvantages may result, which is not only reduction of reliability upon the products, but also reduction of service life or/and yield.

In view of the above problems, the present invention has been proposed. An object of the present invention is to provide a conductive member, which is superior in operation characteristics to cause the resistant value to change sharply in a narrow operation temperature range, and an electric device like thermistor, which is equipped with the conductive member to further increase the reliability and a manufacturing method thereof.

In order to solve the above problems, the inventor et al. intensively studied thereon. As a result, it was found that the above object can be achieve by using a specific carbon material as the electric conductor constituting the conductive member used in electric devices such as thermistor, and thus, the present invention has been achieved.

That is, a conductive member in accordance with the present invention is formed from a resin including an electric conductor, and the electric conductor includes mainly at least any one element of the following elements (a) to (c). Here, element (a) is a residual material of a synthetic carbonaceous material including fullerenes generated in the preparation step of fullerenes from which at least a part of the fullerenes is removed; element (b) is a compound having a molecule skeleton formed of a carbon cluster, which includes at least one 5-membered ring and at least one 6-membered ring and has an open end; and element (c) is a carbonaceous compound having a non-peak distribution due to its amorphous structure in a region where $2\theta$ is 30° or less in an X-ray diffraction spectrum.

The synthetic carbonaceous material including the fullerenes is preferably generated via a predetermined arc discharging method or a predetermined combustion method. In particular, more suitably, the electric conductor includes oxygen atoms of 0.5 to 30 mass % and hydrogen atoms of 0.05 to 1 mass %.

The wording "a predetermined arc discharging method" in the present invention means the following method. That is, in a chamber in which an inert gas such as helium or argon is sealed and which is maintained to a specific pressure (preferably 0.01 to 100 kPa, more preferably 1 to 40 kPa), an electrode couple formed mainly from carbon (for example, graphite electrode couple) is set being parted away from each other at a specific distance (preferably, 5 to 50 mm, more preferably 10 to 30 mm). A specific DC or AC voltage is applied to the electrode couple (preferably 10 to 200 V, more preferably 20 to 100 V) to generate arc discharge between the electrodes; thus, the fullerenes are synthesized. As for such method, in particular, for example, there is given a method disclosed in Nature Vol. 347, P354, 1990.

Also, the wording "a predetermined combustion method" in the present invention means the following method. That is, an organic compound mainly including carbon atom and hydrogen atom in its molecule (for example, toluene, benzene, xylene, naphthalene, hexane or the like) is combusted imperfectly to synthesize fullerenes. As for such method, in particular, for example, there is given a method disclosed in Nature Vol. 352, P139, 1991.

In the element (a), as for the method for generating the synthetic carbonaceous material, in addition to the predetermined arc discharging method or the predetermined combustion method, various methods such as laser ablation method, vapor phase thermal decomposition method, chemical vapor phase deposition method, hydrothermal synthesis method and the like are applicable. Also, the synthetic carbonaceous material itself, which is used as the material for the element (a), includes the "residual material" as the element (a). When the synthetic carbonaceous material includes the "residual material" component of an amount equal to or more than that of the removed fullerenes, the material also is included in the electric conductor of the present invention.

Further, the wording "fullerenes" in the present invention means any molecule fallen under the category of the following (1) and (2).

(1) A molecule, which has a carbon cluster of a spherical shell or a closed tubular shape as its bone structure and which is a cage-type molecule having 20 or more carbon atoms; each of carbon atoms is three coordinations (this definition is based on the IUPAC advisory 2002), including a closed polyhedron cage-type molecule, which formed of 20 or more than even number of carbon atoms and has 12 pentangular faces and hexagonal faces of (n/2−10; n is a number of the carbon atoms) (this definition is based on the IUPAC (A Preliminary Survey, 1997)).

(2) A molecule, which has a closed pseudosphere structure including 20 or more carbon atoms each combined with neighboring 3 atoms; the number of members of each ring is not particularly limited to (this definition is based on the definition by CAS; so called, quasi-fullerene is included).

The wording "fullerenes" in the present invention includes saturated fullerene (for example, $C_{60}H_{60}$), which is perfectly hydrogenated; i.e., fullerane, and fulleroid such as heterofullerene, norfullerene, homofullerene, and secofullerene.

Further, the compound of the above element (b) is, to speak in other words in connection with the fullerene, a non-fullerene compound. Such compound may be either one in which at least one hydrogen atom has been substituted by other atom (substituted body), or one in which no hydrogen atom is substituted (unsubstituted body).

Furthermore, about the element (c), the wording "a non-peak distribution due to amorphous structure in a region where 2θ is 30° or less" means a broad distribution which can not be determined as a peak; for example, the range of 2θ resides in a range of approximately 5° or more. This distribution has a counting or a counting ratio significantly larger than that of the background of the region where 2θ exceeds 30°. The peak may reside in a region where 2θ is 30° or less. In this case, the X-ray diffraction spectrum shows such a shape that the peak is overlapped with non-peak distribution.

Completely different from conventionally used electric conductors formed of a carbon black powder or the like, the electric conductor in the conductive member, which has a constitution as described above, is superior in resolving or being dispersed in an organic solvent. Owing to this, the electric conductor can be used in a state of solution for forming the conductive member.

Accordingly, for example, the conductor solution can be adhered to the surface of solid resins, or can be blended uniformly with a liquid state resin or a liquid of monomer. This is extremely difficult in the conventional art, which uses a carbon black powder or the like. Particularly, in the latter case, the dispersing performance of the electric conductor in the matrix resin for the conductive member is largely increased.

Therefore, in particular, the conductive member according to the present invention is preferably formed of a plurality of conductor particles being piled up, in which each conductor particle has a resin particle formed of a resin and a conductive layer formed of the above electric conductor, which is formed on the surface of the resin particle.

By piling up these particles, each conductive layer formed on the surface of the respective resin particles is brought into contact with each other and integrated. In a kind of a three-dimensional mesh-like network of the conductive path is established and thus the electric conductivity is obtained. And as the temperature rises, regions corresponding to each resin particle are inflated in volume, and thereby cracks are developed in the conductive layer. And finally, the connection among the conductive layers is cut off, and accordingly, the resistance value of the entire conductive member is caused to increase.

Here, since the conductive layer is formed on the surface of the resin particles from the beginning, even when the inflation of the resin accompanying the temperature rise is very small, the conductive path is readily cut off. As result, it is understood that the resistance value can be changed sharply in a narrow temperature range. However, the working effect is not limited to the above.

Or, the conductive member is formed by dispersing the electric conductor in a resin. That is, as described above, both of the resin (or monomer thereof) and the electric conductor are blended in a state of liquid. It is preferable that the electric conductor is dispersed in the resin in a state of, so to speak, solid solution.

Owing to this, compared to the conventional manner in which solid state electric conductors are dispersed in the resin by means of mixing or the like, the dispersion performance of the electric conductor; i.e., the uniformity within the resin is largely increased. Therefore, owing to the inflation of the resin accompanying the temperature rise, the conductive path is cut off not locally but uniformly. As result, the resistance value can be changed sharply and reliably within a narrow temperature range. Although the solid-state electric conductors, which mainly include at least any one element of the above elements (a) to (c), may be dispersed in the resin in the same manner as the conventional manner, it is preferred that both of the resin (or monomer thereof) and the electric conductor are blended in a state of liquid.

Further, a manufacturing method of a conductive member according to the present invention is a method for effectively manufacturing the conductive member of the present invention, which comprises a particle forming step in which resin particles are formed from the resin; a coating step in which the resin particles are brought into contact with a conductor solution including mainly at least any one element of the above elements (a), (b) and (c) being dissolved or dispersed in a solvent to adhere the conductor solution to at least a part of the surface of the resin particles; and a removal step in which the solvent is removed from the conductor solution adhered to the resin particles.

Or, a manufacturing method of a conductive member according to the present invention may be a method which comprise a blending step in which a conductor solution including mainly at least any one element of the above elements (a), (b) and (c) being dissolved or dispersed in a solvent and a monomer solution including a monomer constituting the resin or a resin solution dissolved with the resin in a solvent are blended, and a polymerizing step in which the monomer included in the monomer solution is allowed to polymerize to form the resin, or the resin included in the resin solution is cured.

In particular, in the above coating step or blending step, the electric conductor preferably includes oxygen atoms of 0.5 to 30 mass % and hydrogen atoms of 0.05 to 1 mass % is preferably used.

Furthermore, an electric device according to the present invention having a conductive member including a resin and an electric conductor, comprises an electrode couple; and a conductive member, which is provided between the electrodes constituting the electrode couple and formed from a resin including an electric conductor including mainly at least any one element of the above elements (a), (b) and (c). In particular, the electric conductor preferably includes oxygen atoms of 0.5 to 30 mass % and hydrogen atoms of 0.05 to 1 mass %.

Still further, a manufacturing method of an electric device according to the present invention is a method for effectively manufacturing the electric device of the present invention, which comprises a particle forming step in which resin particles are formed from the resin; a coating step in which the resin particles are brought into contact with a conductor solution including mainly at least any one element of the above elements (a), (b) and (c) being dissolved or dispersed in a solvent; a removal step in which the solvent is removed from the conductor solution adhered to the resin particles; a conductive member forming step in which the conductive member is formed by piling up a plurality of resin particles from which the solvent is removed; and a disposing step in which the conductive member is disposed between the electrodes constituting the electrode couple.

Or, a manufacturing method of an electric device according to the present invention may comprise a blending step in which a conductor solution including mainly at least any one element of the above elements (a), (b) and (c) being dissolved or dispersed in a solvent and a monomer solution including a monomer constituting the resin or a resin solution dissolved with the resin in a solvent are blended; a polymerizing step in which the monomer included in the monomer solution is allowed to polymerize to form the resin, or the resin included in the resin solution is cured; and a disposing step in which the conductive member is disposed between the electrodes constituting the electrode couple. In this case also, in the above coating step or blending step, as the electric conductor, the electric conductor including oxygen atoms of 0.5 to 30 mass % and hydrogen atoms of 0.05 to 1 mass % is preferably used.

In the above described manufacturing method of the conductive member and the electric device, the method, which includes a removal step for removing the solvent from the conductor solution adhered to the resin particles, is suitable for manufacturing method of, particularly, thermoplastic conductive member and electric device. On the other hand, the method, which includes a polymerizing step for polymerizing a monomer included in the monomer solution to form the resin, is suitable to the manufacturing method of any of thermoplastic or thermosetting conductive member and electric device. The method, which includes a polymerizing step for curing the resin included in the resin solution, is particularly suitable for the manufacturing method of thermosetting conductive member and electric device.

BEST MODE FOR CARRYING OUT THE INVENTION

Figure 1:
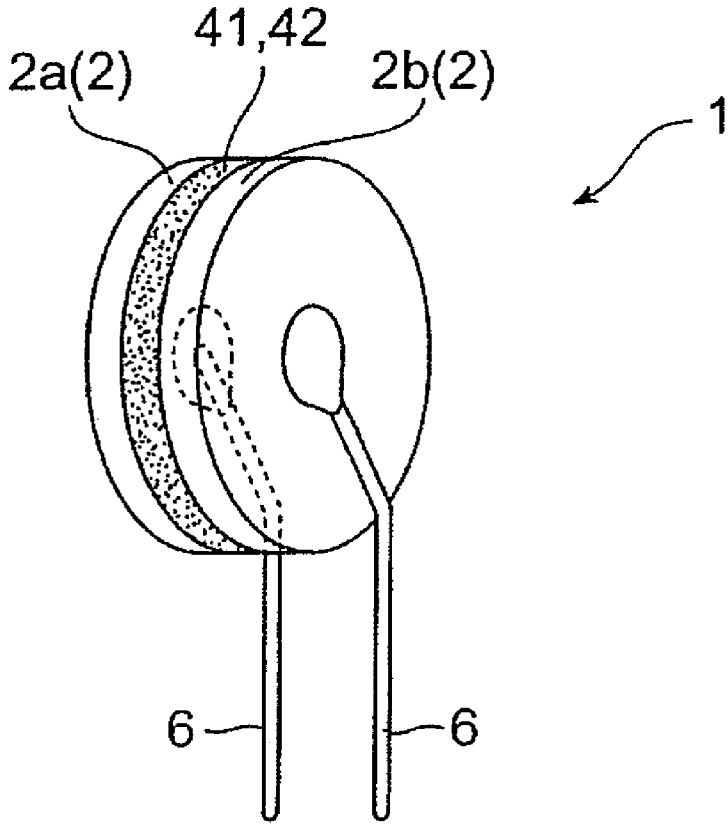
FIG. 1 is a perspective view showing a preferred embodiment of an electric device of the present invention equipped with a conductive member in accordance with the present invention.

Hereinafter, embodiments of the present invention will be described in detail with reference to the drawings. The identical elements will be given with the identical reference numerals, and redundant descriptions thereof will be omitted. The positional relationship like up/down or right/left is based on the positional relationship in the figures.

FIG. 1 is a perspective view showing a preferred embodiment of an electric device of the present invention equipped with a conductive member in accordance with the present invention. An electric device 1 is an organic positive thermistor, in which, between two plate electrodes 2*a* and 2*b* (electrodes) constituting an electrode couple 2, a conductive member 41 or a conductive member 42, which will be described later in detail, is disposed in a state of close contact with the plate electrodes 2*a* and 2*b*.

If electric conductivity is obtained, the material for each plate electrode 2*a*, 2*b* provided for sandwiching the conductive member 41 or 42 is not particularly limited to. For example, metals such as nickel and copper, which are ordinarily used as electrode plates, are given.

On the outer surface of the respective plate electrodes 2*a* and 2*b*, mounting leads 6 and 6 are joined by means of soldering, brazing or the like. These mounting leads 6 and 6 serve as the lead wires for mounting the electric device 1 onto a load circuit and the like. If the electric conductivity is obtained, the material for the mounting leads 6 and 6 is not particularly limited to.

The conductive member 41 or 42 is, so called, a conductive polymer formed of a resin including an electric conductor.

Figure 2:
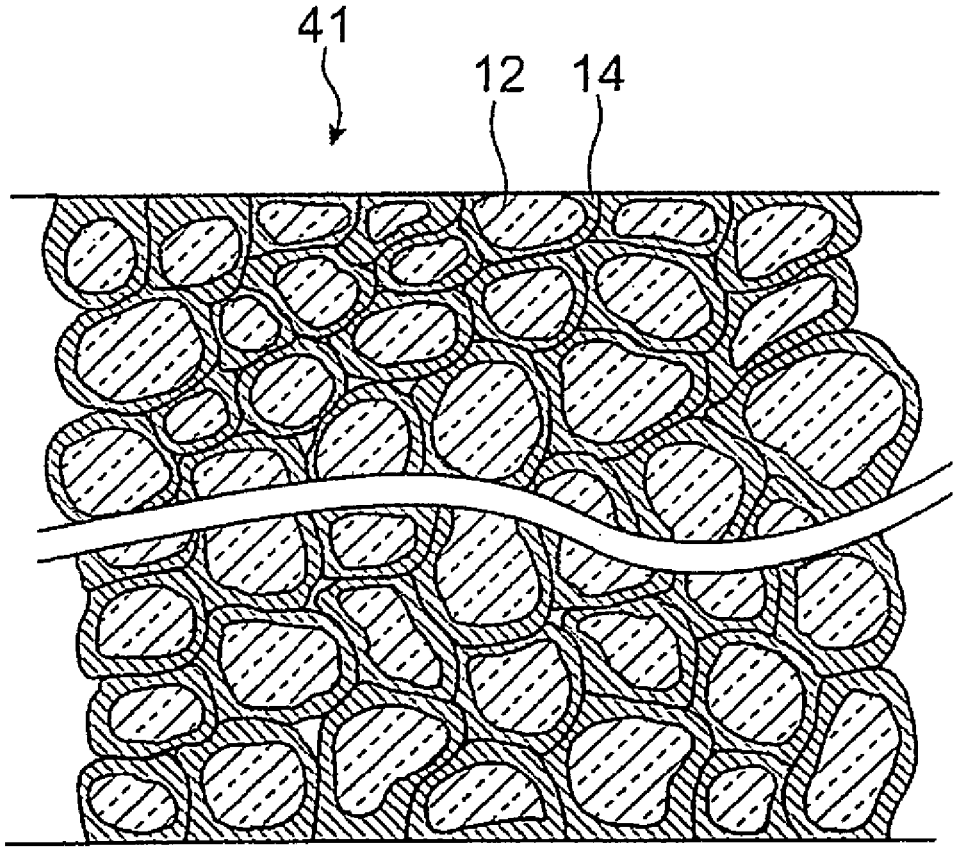
FIG. 2 is a sectional view schematically showing a conductive member 41.
Figure 3:
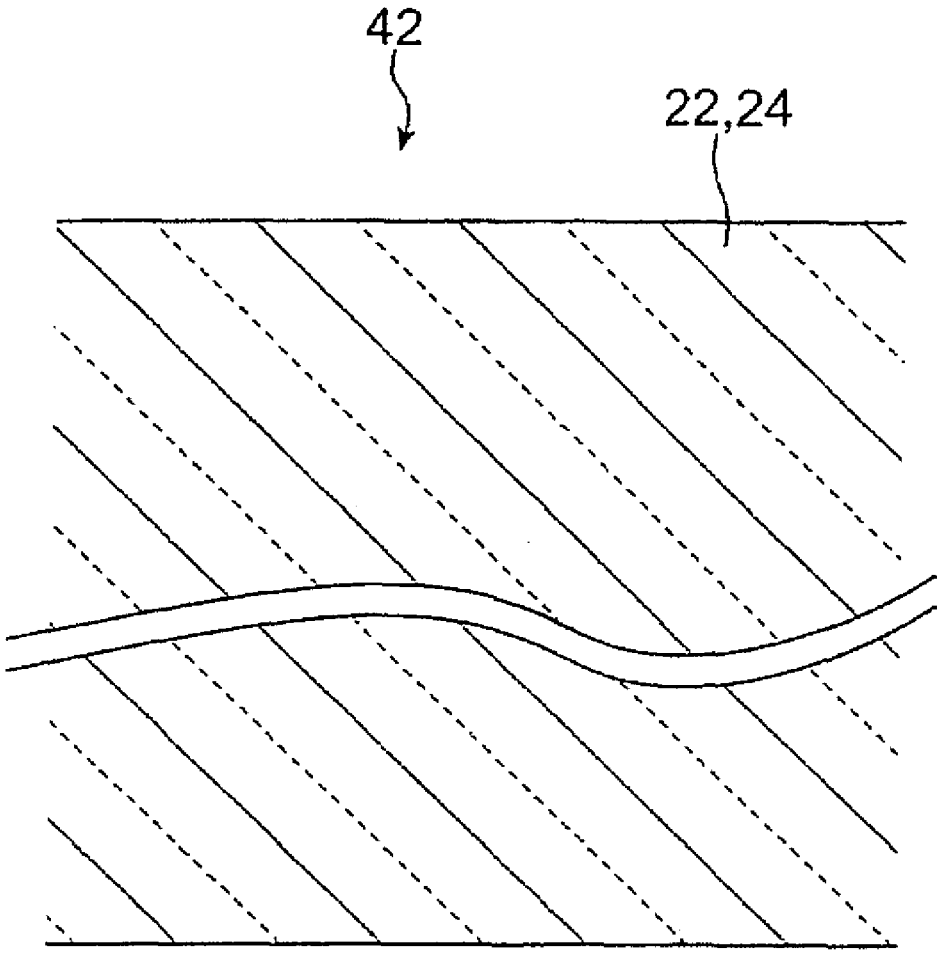
FIG. 3 is a sectional view schematically showing a conductive member 42.

Here, FIG. 2 and FIG. 3 are sectional views each schematically showing a conductive member 41, 42.

Referring to FIG. 2, the conductive member 41 is formed of a plurality of resin particles 12 piled up so as to come into close contact with each other; and the surface of the resin particles 12 is covered by a conductive layer 14 at least partially, preferably a large part of its surface, more preferably, substantially the entire surface thereof. The conductive layers 14 formed on the surface of the respective resin particles 12 are chemically or physically joined so as to come in contact with each other; thereby a three-dimensional network of a conductive path is built up. The conductive layer 14 may not be always formed in a layered structure, or in a film state. The conductive layer 14 is expressed as shown in FIG. 2 as a matter of convenience for description. However, for example, such mode that fine particles of electric conductor are adhered to the surface of the resin particles 12 may be also employed.

On the other hand, referring to FIG. 3, in the conductive member 42, electric conductor 24 is dispersed in a resin 22 with high uniformity. In particular, the electric conductor 24 is included as a plurality of extremely fine particles (not shown) within the resin 22 as a matrix; or, it is conceivable that the electric conductor 24 is included in the resin 22 in a state of, so to speak, solid solution. In any case, the electric conductor 24 is chemically or physically joined with each other and a three-dimensional network of the conductive path is built up.

As described above, the conductive member 41 or 42 is formed of a resin including electric conductors. Such electric conductors, i.e., electric conductors constituting the conductive layer 14 and electric conductor 24 are formed including at least any of one element mainly from the following (a) element, (b) element, and (c) element.

That is, the (a) element is a residual material after removing at least a part of the fullerenes from a synthetic carbonaceous material including fullerenes generated by means of a predetermined arc discharging method, a predetermined combustion method or a predetermined laser ablation technique. Also, the (b) element is a compound having a molecule skeleton formed of a carbon cluster, which includes at least one 5-membered ring and at least one 6-membered ring and has an open end. Further, the (c) element is a carbonaceous compound, which has a non-peak distribution due to amorphous structure in the region where $2\theta$ is 30° or less in an X-ray diffraction spectrum.

In the conductive member 41, 42, the content ratio of oxygen (O) atom in the conductive layer 14 and the electric conductor 24 is, preferably, 0.5 to 30 mass %; more preferably, 5 to 30 mass %, particularly preferably 10 to 30 mass %. Further, the content ratio of hydrogen (H) atom in the conductive layer 14 and the electric conductor 24 is, preferably, 0.05 to 1 mass %, more preferably 0.1 to 1 mass %, further preferably, 0.2 to 1 mass %.

As prescribed above as the (a) element, the electric conductor constituting the conductive layer 14 and the electric conductor 24 is formed of a residual material after at least a part of fullerenes is removed from a synthetic carbonaceous material including fullerenes. The fullerenes may be inevitably included at a concentration of, for example, 0.5 ppm to 10 mass %, more preferably, several ppm to 5 mass % or so.

In this case, in the synthetic carbonaceous material for obtaining fullerenes, various kinds of fullerenes such as $C_{60}$, $C_{70}$ may be included. The compositional ratio (for example, $C_{60}/C_{70}$ ratio) of the various fullerenes in, so-called, fullerenes soot extracted from the synthetic carbonaceous material and the compositional ratio of the various fullerenes in the residual material may be the same or different from each other. More particularly, when the conductive layer 14 and the electric conductor 24 includes the fullerenes, the $C_{60}/C_{70}$ ratio is, preferably, 0.1 to 10; more preferably, 0.1 to 5; further preferably, 0.1 to 3 or so.

Further, as a kind of the (a) element, when a residual material obtained from a synthetic carbonaceous material, which includes fullerenes generated by means of the arc discharging method using graphite (carbon black) electrode, is used for the electric conductor, a part of the graphite electrodes, which is broken away by the arc discharge, may be mixed in the residual material. In such a case, it was found that a peak due to the graphite crystal was observed in the X-ray diffraction spectrum of the electric conductor.

In this case, as a result of measurement of the interlayer distance ($d_{002}$) in the graphite, which is used as the electrodes for arc discharge, and microcrystal carbon in the above residual material by means of X-ray diffraction method, it was found that, compared to the distance in the graphite, the distance in the residual material was significantly large (for example, 0.340 nm or more). Further, in the above case, compared to the fullerene soot, the measured tap density (bulk density) of the residual material exhibited an extremely small value. For example, the tap density of the residual material is 0.1 to 1 g/cm$^3$ or so same as or less than that of ordinary active carbon. Contrarily, it was found that the tap density of the fullerene soot was 0.035 g/cm$^3$ or so.

Further, in the methods for generating the synthetic carbonaceous material for obtaining the (a) element; i.e., the predetermined arc discharging method, the combustion method and the laser ablation technique, since the production amount is relatively large, the predetermined arc discharging method and the combustion method are preferred. Further, when the mixture of the graphite as described above causes a problem, the predetermined combustion method, which is free from such problem, is more preferred.

As for the resin for the resin particles 12 and the resin 22, a thermoplastic resin or thermosetting resin, which is generally used as a polymer matrix for organic positive thermistor, is available. As for the thermoplastic resin, polyolefin, halogen polymer, polystyrene, thermoplastic elastomer and the like are given. In more particularly, for example, a thermoplastic resin disclosed in Japanese Patent Application Laid-open No. 2000-82602 may be preferably used.

Also, as for the thermosetting resin, epoxy resin, unsaturated polyester resin, polyimid, polyurethane, phenolic plastic, silicone and the like are given. In more particular, for example, a thermosetting resin disclosed in Japanese Patent Application Laid-open No. 2000-223303 may be preferably used.

These thermoplastic resins or thermosetting resins may be appropriately selected based on the desired performance, the purpose and the like required for the electric device in which the conductive member 41 or 42 is used. Each of the resins may be used independently. Or, two or more resins may be use in combination. Also, the resin of the resin particles 12 and the resin materials for forming the resin 22 may be added with an appropriate amount of other elements such as antioxidant for prohibiting the deterioration of the resin, additive for increasing the thermal conductivity, inorganic solid such as metal oxide for increasing durability, boron carbide for increasing withstand voltage performance and the like.

Hereinafter, manufacturing method of the electric device 1 having the above-described constitution will be described.

[First Manufacturing Method]

Figure 4:
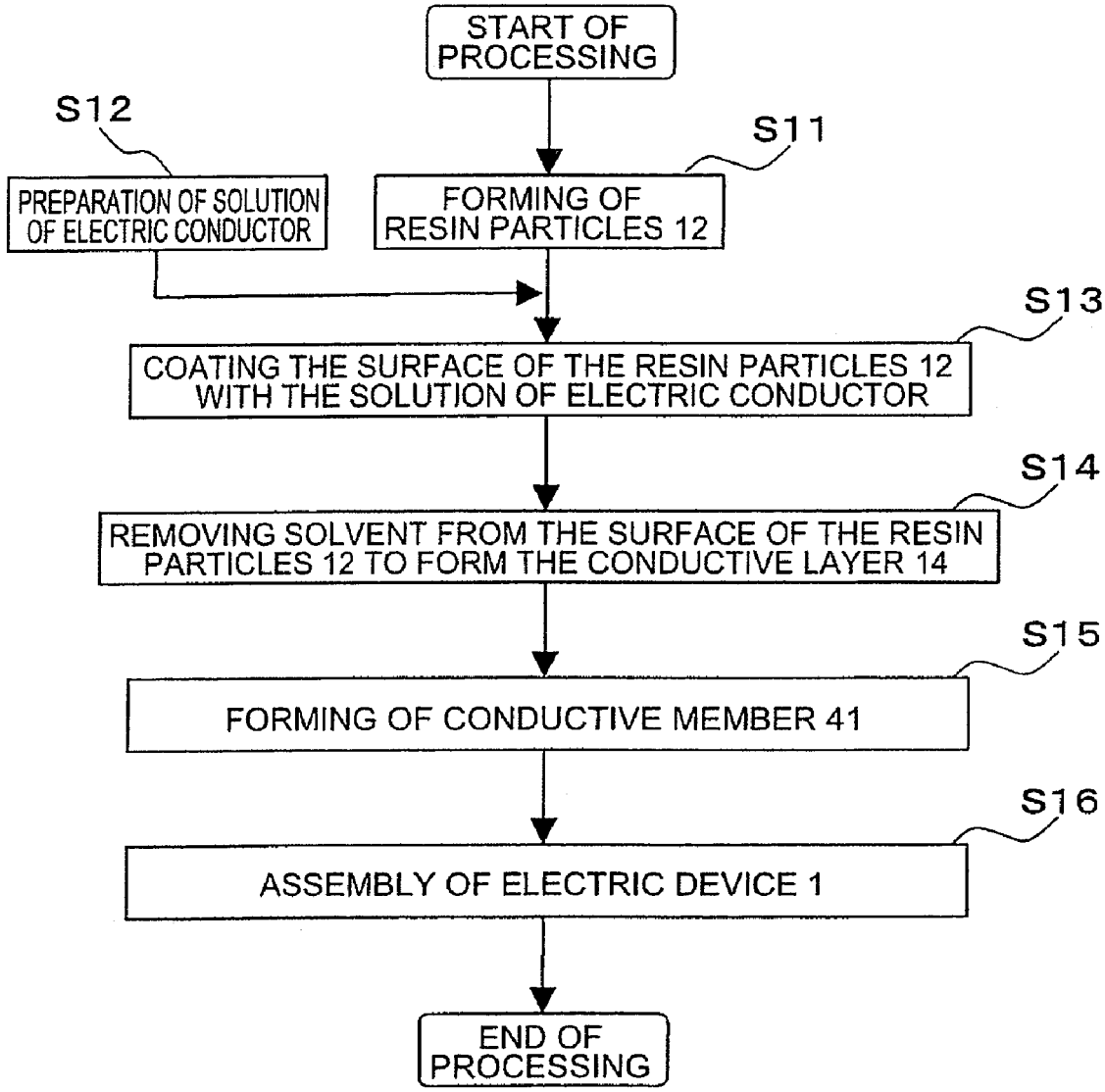
FIG. 4 is a flowchart showing an example of a procedure of manufacturing an electric device 1 equipped with a conductive member 41 in accordance with a manufacturing method of electric device of the present invention.

FIG. 4 is a flowchart showing an example of the procedure to manufacture the electric device 1, which is equipped with the conductive member 41 (refer to FIG. 2), in accordance with a manufacturing method of the electric device of the present invention. In the first manufacturing method, the process starts, first of all, by forming the resin particles 12 of the above-described resin (step S11; particle forming step). The forming method of the resin particles 12 is not particularly limited to. After polymerizing and setting monomer into resin, and then, the resin may be divided to process into fine particles. Or, the monomer may be previously divided into small amount, and then, polymerized and set to obtain fine particles.

Also, in concurrence with step S11, an electric conductor, which mainly includes any one of the above-described elements (a) to (c), is dissolved or dispersed in an appropriate solvent to prepare a solution of electric conductor (step S12). If the electric conductor can be dissolved or dispersed, the solvent to be used is not particularly limited to. For example, benzene, toluene, xylene, ethylbenzen, propyl benzene, isopropyl benzene, butylbenzene, trimethylbenzene, tetramethylbenzene, methylnaphthalene, tetralin, anisole, chlorobenzene, dichlorobenzene, trichlorobenzene, bromobenzene, iodosobenzene, dekalin, tetrachloroethane, carbon disulfide, 2-methylthiophene and the like are given. In these solvents, hydrocarbon solvent such as toluene is preferred; and toluene is particularly preferred.

In the conductor solution, the electric conductor may not be dissolved or dispersed entirely in the solvent. However, since the conductive layer 14 is formed in a large portion of the surface of the resin particles 12, it is preferred that substantially the entire electric conductor is dissolved or dispersed in the solvent.

To manufacture the electric conductor prior to step S12, as described in the description of the (a) element, the following method may be employed. That is, at least a part of, preferably a large part of the fullerene, is removed from the synthetic carbonaceous material including the fullerene, which is generated by means of the predetermined arc discharging method, combustion method, or laser ablation technique.

In more particular, a case where the arc discharging method is employed will be described below as an example. First of all, in a substantially spherical chamber, which is connected to a supply system and a high-pressure pump of helium gas or argon gas, two graphite electrodes having a rod-like shape are disposed so as to one ends thereof faces to each other within the chamber. After sealing the chamber, the pressure of the inside thereof is reduced. In this state, after preheating the graphite electrodes, the inside of the chamber is filled with helium gas or argon gas. After that, while turning the graphite electrodes connected to a high-voltage DC power source, a high voltage is applied thereto to generate an arc discharge between the electrodes so as to generate carbon vapor. After carrying out the arc discharge for a predetermined period of time, soot adhered to the inner wall of the chamber is recovered (recovered soot; synthetic carbonaceous material).

Next, the recovered soot is put into a container containing a solvent (toluene etc), which is the same solvent as that used for preparing of the above-described conductor solution, and agitated to mix therewith. Then, the fullerenes are extracted from the mixture. After that, the fullerene residual is recovered and cleaned with water, and then, dried under a reduced pressure. Thus, the fullerene residual as the residual material in the present invention is obtained. Since mainly fullerenes are included, the filtered solution of the mixture is separately recovered for condensing and purifying the fullerenes.

Or, the recovered soot is heated to a temperature of 400° C. or more; thereby the fullerenes are sublimed (sublimation temperature of the fullerenes is approximately 400° C.). The sublimed fullerenes are collected and recovered by means of cold trapping. The obtained residual is the residual material in the present invention.

Next, the resin particles 12 are put into and mixed with the prepared conductor solution to dip them, or the prepared conductor solution is sprayed to coat the resin particles 12; thereby, the resin particles 12 are brought into contact with the conductor solution. Thus, the conductor solution is allowed to adhere to the surface of the resin particles 12 (step S13: coating step).

Next, the solvent, which is included in the conductive solution and adhered to the surface of the resin particles 12, is removed, and the conductive layer 14 is formed on the surface of the resin particles 12 (step S14: removal step). The solvent may be removed by, for example, heating the resin particles 12 adhered with the conductive solution to a temperature at which the solvent evaporates or emits. In the case where the resin particles 12 are of thermoplastic resin, the solvent can be removed by heating the resin particles 12 to a temperature satisfactorily lower than the melting point or softening point thereof. The heating is preferably carried out under the atmospheric pressure or a reduced pressure.

Next, a plurality of resin particles 12 having the conductive layer 14 is piled up; and further joined integrally to each other. Thus, the conductive member 41 having a plate-like shape is formed (step S15: conductive member forming step). As for further particular method, such a method that resin particles 12 are received in a mold having a plate-like shape, compressed to mold and is separated therefrom is given.

Here, the resin particles 12 having the conductive layer 14 can be arbitrarily molded into a sheet-like shape or a plate-like shape having a larger thickness in accordance with the thickness of the conductive member 41 to be formed. Further, after forming a molded object having a large area, the object may be punched out to the shape of the conductive member 41, or the shape of the mold may be formed to the shape of the conductive member 41. Or, after forming aggregated molded object, the molded object may be processed into the shape of the conductive member 41. Further, in order to increase the connection performance of the resin particles 12, a binder may be appropriately used.

Then, the plate electrode 2*a*, the conductive member 41, and the plate electrode 2*b* are piled up in that order, and joined to each other with the pressure or the like. The mounting leads 6 and 6 are mounted to the outer surface of the plate electrodes 2*a* and 2*b* respectively. Thus, the electric device 1 is assembled and the process is completed (step S16: disposing step). Or, before piling up the plate electrode 2*a*, the conductive member 41 and the plate electrode 2*b*, the mounting leads 6 and 6 may be previously mounted to the plate electrodes 2*a* and 2*b*.

Further, a part of the above step S15 and step S16 may be carried out simultaneously. As a particular method, such a method that a mold using the plate electrodes 2*a* and 2*b* as parallel plates is filled with the resin particles 12 formed with the conductive layer 14, and the resin particles 12 is joined with the pressure along with the plate electrodes 2*a* and 2*b* is given. In this case, the disposing step includes the conductive member forming step.

[Second Manufacturing Method]

Figure 5:
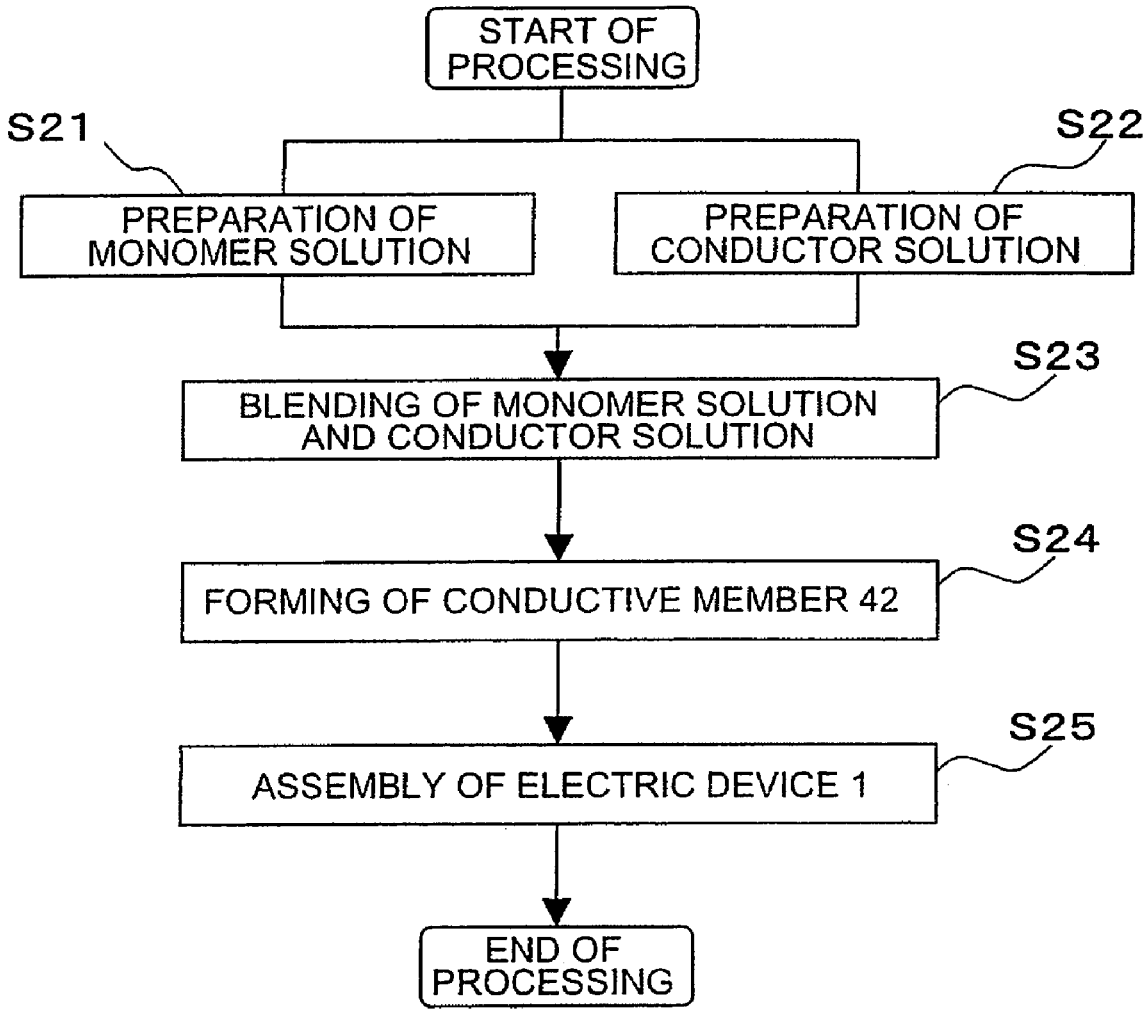
FIG. 5 is a flowchart showing an example of a procedure of manufacturing an electric device 1 equipped with a conductive member 42 in accordance with a manufacturing method of electric device of the present invention.

FIG. 5 is a flowchart showing an example of the procedure to manufacture the electric device 1, which is equipped with the conductive member 42 (refer to FIG. 3), according to the manufacturing method of the electric device of the present invention. In the second manufacturing method, the process is started, first of all, by dissolving a monomer constituting the resin 22 into a solvent. And further, if necessary, an additive such as polymerization initiator is added to prepare a monomer solution (step S21). If a satisfactory compatibility with the monomer is obtained, the solvent is not particularly limited to. However, a solvent, which is capable of dissolving or dispersing the electric conductor also, is preferable. When the monomer is liquid state at a room temperature and also acts as the polymerizing solvent, any solvent is not required.

In concurrence with step S21, an electric conductor including mainly any one element of the above-described elements (a) to (c) is dissolved or dispersed into the solvent to prepare a conductor solution (step S22). If the solvent is capable of dissolving or dispersing the electric conductor, the solvent is not particularly limited to. However, a solvent, which has satisfactory compatibility with the monomer, is preferable.

The prepared monomer solution and conductor solution are blended and agitated satisfactorily to obtain blended solution thereof (step S23). The blending step includes step S21 to S23 as described above. As for the blended solution, at least a part of the monomer and the electric conductor may be dissolved or dispersed in the solvent. However, in order to cause the polymerization and reaction to occur efficiently and satisfactorily latter, it is preferred that the monomer and the electric conductor are entirely dissolved or dispersed satisfactorily. In this viewpoint, as described above, it is preferred that each of the solvents of the monomer solution and the conductor solution are identical to each other. When the solvents are the identical to each other, the blending of them can be carried out easily, and the uniformity therebetween in the blended solution is increased. And further, when the solvent has to be removed in the latter polymerization step, the step can be carried out easily.

Next, the monomer within the blended solution is allowed to polymerize; thereby the conductive member 42 formed of the resin 22 in which the electric conductor 24 is uniformly dispersed, is obtained (step S24: polymerizing step). In particular, for example, a parallel plate frame (mold) structured with a glass plate and sealing member is filled with the blended solution, and is heated and cooled at a predetermined temperature inclination; thereby the monomer is allowed to polymerize; and thus, a resin molded object is obtained.

Here, the resin 22 uniformly dispersed with the electric conductor 24 can be arbitrarily molded into a sheet-like shape or a plate-like shape having a larger thickness in accordance with the thickness of the conductive member 42 to be formed. Further, after forming a molded object having a large area, the object may be punched out to the shape of the conductive member 42. Or the shape of the mold may be formed to the shape of the conductive member 41. Or, after forming aggregated molded object, the molded object may be processed into the shape of the conductive member 42.

If the solvent in the blended solution evaporates and scatters to the outside accompanying the polymerizing reaction of the monomer, another process to remove the solvent is not required. When a solvent, which does not evaporate accompanying the polymerizing reaction, is used, if necessary, it is preferable to remove the solvent before or after step S24.

Then, the plate electrode 2*a*, the conductive member 42, and the plate electrode 2*b* are piled up in that order, and joined to each other with the pressure or the like. The mounting leads 6 and 6 are mounted to the outer surface of the plate electrodes 2*a* and 2*b* respectively. Thus, the electric device 1 is assembled and the process is completed (step S25: disposing step). Or, before piling up the plate electrode 2*a*, the conductive member 42 and the plate electrode 2*b*, the mounting leads 6 and 6 may be previously mounted to the plate electrodes 2*a* and 2*b*.

Further, a part of step S24 and step S25 may be carried out simultaneously. As a particular method for that, the following method is given. That is, a press mold using the plate electrodes 2*a* and 2*b* as the parallel plates is filled with the above-described blended solution, and the monomer is allowed to polymerize along with the plate electrodes 2*a* and 2*b*. In this case, the disposing step includes the conductive member forming step, and removing step of the mold after polymerization is not required.

In step S21, the following method may be employed. That is, in place of the monomer solution including the monomer, a resin solution in which the resin 22 is dissolved in a solvent is prepared. And in step S24, the solvent is, for example, heated to sublimate. Thus, the solvent is removed and the resin is cured.

Figure 6:
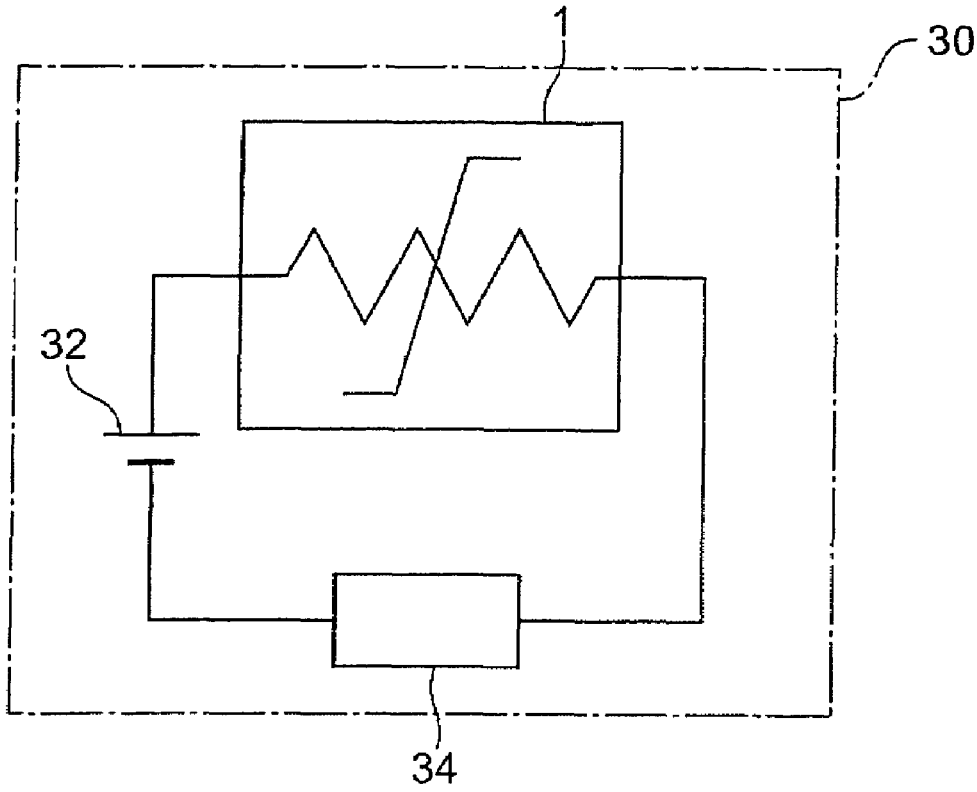
FIG. 6 is a circuit diagram schematically showing an example of a circuit system using the electric device 1 as an over current protector.

FIG. 6 is a circuit diagram schematically showing an example of a circuit system employing the electric device 1, which is an organic positive thermistor, as an over current protector. In a circuit system 30, the electric device 1 as the over current protector is connected to a power supply 32 and a load 34 connected thereto in the forward direction with respect to the direction of the current.

In the electric device 1 including the conductive members 41 and 42, which has the above-described structure, and the circuit system 30 equipped therewith, the conductive layer 14 and the electric conductor 24, which are included in the conductive members 41 and 42, form the conductive path. Therefore, the conduction within the electric device 1 is satisfactorily ensured. Accordingly, during normal operation under appropriated temperature conditions, a steady current flows through the electric device 1. Contrarily, when the load 34 is operated under a non-steady state such as overload, or at an abnormality like an inrush current flows through the circuit system 30, an over current flows through the electric device 1.

In such case, in the case where the resin particles 12 and the resin 22 are formed from a thermoplastic resin, when the electric device 1 is heated by the over current, the thermoplastic resin is softened, melted, or fused resulting in a inflation of its volume. Accompanying this, the conductive path constituted of the conductive layer 14 and the electric conductor 24 is cut off, the resistance value increases sharply as the temperature rises and the conduction of the circuit system 30 is shut off.

On the other hand, in the case where the resin particles 12 and the resin 22 are formed from a thermosetting resin, being heated by the over current, when the temperature reaches to the deformation temperature of the resin or the glass-transition temperature, the conductive path is cut off and the resistance value increases sharply as the temperature rises, and the conduction of the circuit system 30 is shut off.

Here, since the conductive layer 14 of the conductive member 41 is formed on the surface of the resin particles 12, even when the inflation of the resin particles 12 accompanying the temperature rise is small, the conductive path is readily shut off. As a result, the resistance value of the electric device 1 changes sharply within a narrow temperature range. Accordingly, even when, for example, an accidental large current flows through the circuit system 30 in a moment of time, the conduction within the electric device 1 and the circuit system 30 accordingly can be reliably shut off in a moment of time. Thus, the failure of the load 34 due to the flow of over current and the like can be satisfactorily prevented.

Also, since the resistance value changes sharply in a narrow temperature range as described above, the accuracy of the operation temperature and the repeatability of the operation can be increased, and differences among the products of the electric device 1 can be reduced. Accordingly, the reliability to the over current protection system in the circuit system 30 can be increased.

On the other hand, in the electric device 1 having the conductive member 42, the electric conductor 24 is dispersed or solved uniformly in the resin 22. Therefore, compared to a conventional method in which a solid-state electric conductor such as a fine particle of carbon black is mixed, dispersed in the resin, the conductive path is, not unevenly but uniformly, shut off due to the inflation of the resin 22 accompanying the temperature rise. Therefore, in this case also, in a narrow temperature range, the resistance value of the electric device 1 can be caused to change sharply and reliably.

Figure 7:
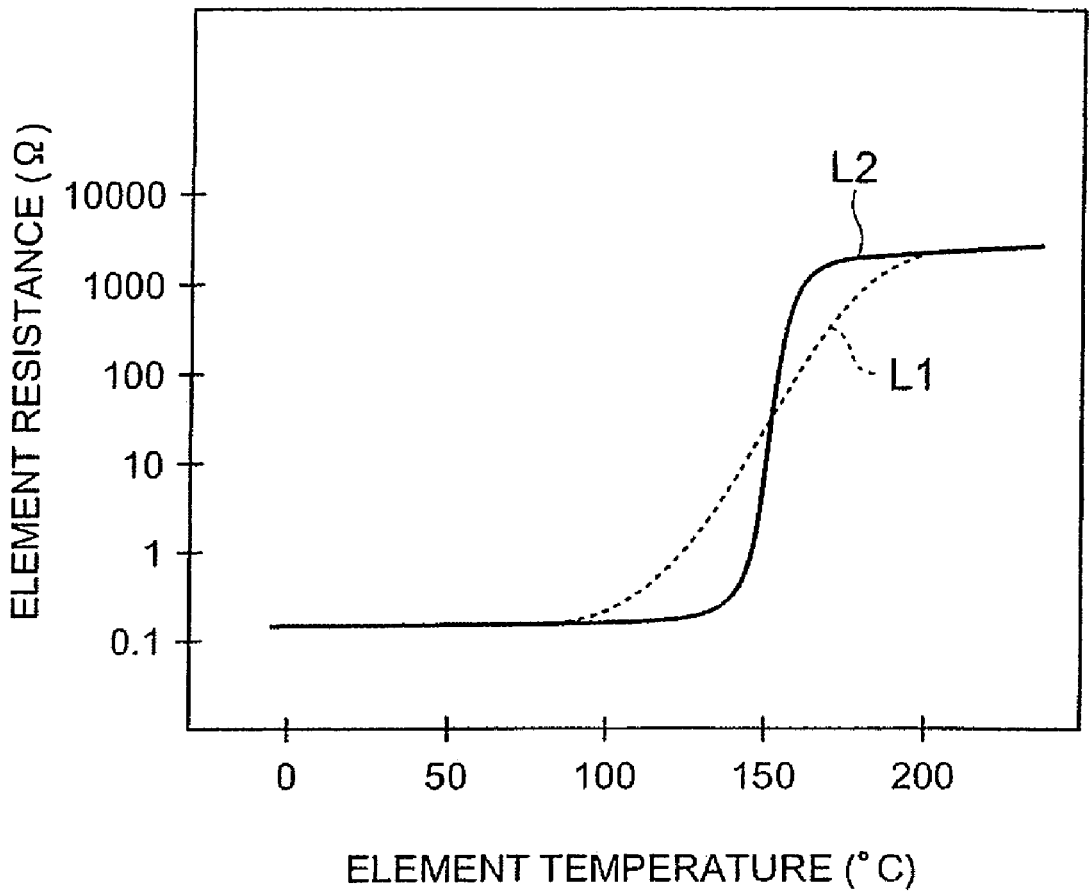
FIG. 7 is a graph schematically showing the changes in resistance of device with respect to the temperature of device in a conventional organic positive thermistor and the electric device 1.

FIG. 7 is a graph schematically showing changes in the resistance of a device (Ω) with respect to the temperature of the device (° C.) of a conventional organic positive thermistor and the electric device 1 in accordance with the present invention. In FIG. 7, curve L1 indicated with a broken line expresses a temperature-resistance curve in a conventional thermistor; and curve L2 indicated with a solid line expresses a temperature-resistance curve in the electric device 1. Both of the abscissa and the ordinate are expressed with relative values. As shown in FIG. 7, the electric device 1 of the present invention shows the following fact. That is, the resistance of the electric device 1 increases and reduces sharply in a temperature range of device narrower than that of the conventional thermistor indicated with the curve L1. In other words, from low temperature to high temperature, the temperature-resistance curve rises sharply.

Further, when manufacturing the conductive member 41, 42, using the conductor solution, the surface of the resin particles 12 can be coated, or, by preparing a blended solution including a monomer solution or a resin solution and a conductor solution being mixed, the blended solution can be polymerized and cured. Such high level and complicated processing operation in a conventional method as mixing and dispersing fine particles of carbon black or the like in a resin can be eliminated. Threfefore, the conductive member 41, 42 in which conductive path is formed uniformly by piling up of the electric conductor can be manufactured employing an extremely simple method. Accordingly, the following advantages can be obtained. That is, the manufacturing process can be simplified and the differences in characteristics among the products can be further reduced resulting in an increase of the yield ratio.

The conductive member in accordance with the present invention, the electric device including the same, the circuit system equipped with the same and the manufacturing and forming method thereof are not limited to the above-described embodiments. Variouse modifications are possible within a range of the sprit of the present invention.

EXAMPLE

Hereinafter, referring to an example, the present invention will be described further in detail. However, the present invention is not limited to the example.

Example 1

(1) Manufacturing of the Electric Conductor

A substantially spherical chamber is connected with a supply system of helium gas or argon gas and a high-pressure pump. In the chamber, two graphite electrodes having a rod-like shape are disposed so that each one end thereof faces to each other. After sealing the chamber, the inside pressure thereof is reduced. In this state, after preheating the graphite electrodes, the chamber is filled with helium gas or argon gas. Then, while turning the graphite electrodes, which are connected to a high-voltage DC power source, around the axis, a high voltage is applied thereto to cause arc discharge to occur between the electrodes. After carrying out the arc discharge for a predetermined period of time, soot adhered to the inner wall of the chamber is recovered (recovered soot; synthetic carbonaceous material).

Next, using toluene as the solvent, fullerenes are extracted via the Soxhlet extraction method. Then, the fullerene residual is recovered, and after being cleaned with water etc, dried under a reduced pressure. Thus, fullerene residual as the residual material in the present invention is obtained. Since mainly fullerenes are included, the filtered solution of the mixture is separately recovered for condensing and purifying the fullerenes.

(2) Analysis of the Fullerene Residual

For the purpose of reference, various kinds of analysis of the obtained fullerene residual were made in accordance with the procedure (1). First of all, a measurement sample was prepared by mixing silicon crystal powder as an internal standard with the powder of the fullerene residual, and under the following conditions, X-ray diffraction spectrum of the measurement sample was measured.

Figure 8:
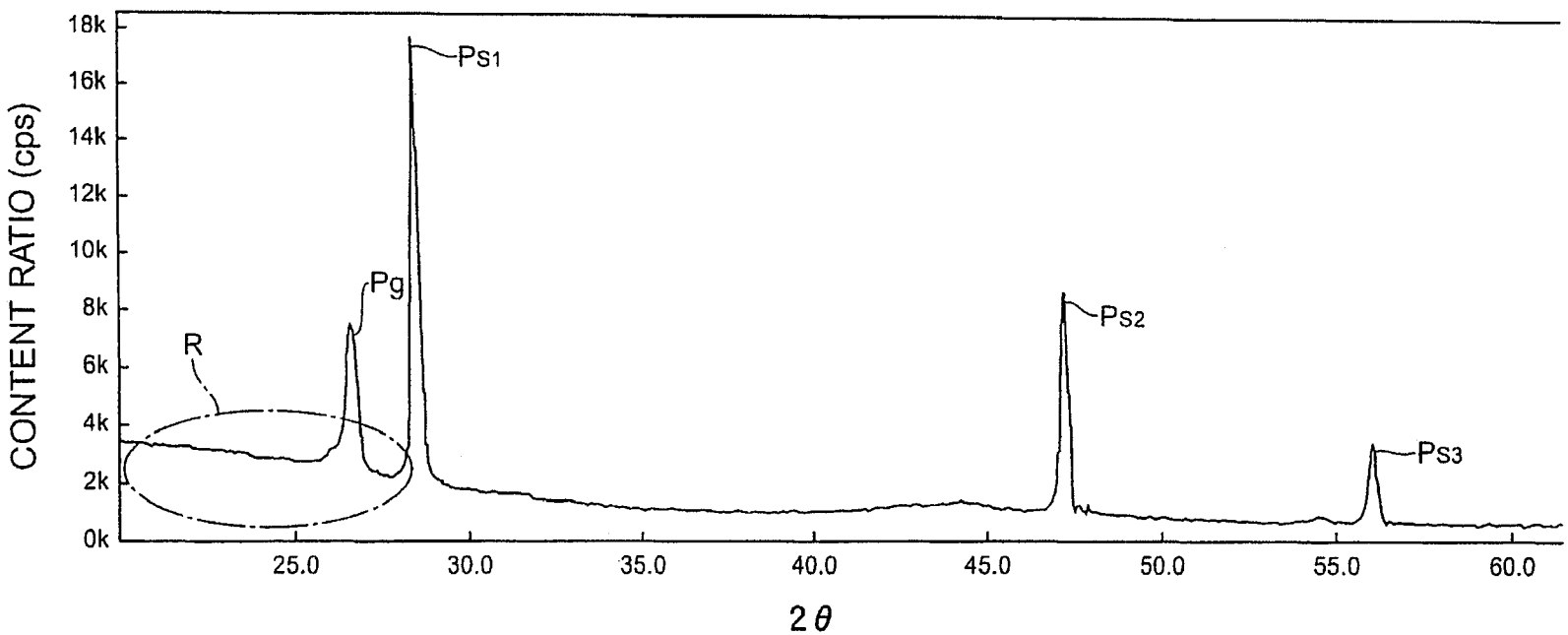
FIG. 8 is a graph showing an X-ray diffraction spectrum obtained with respect to a measurement sample used for measurement of X-ray diffraction spectrum.

X-ray diffractometer: MXP18 manufactured by Max Science
Output of X-ray generator: 18 kW
X-ray source: Cu-A ray (1.54050 keV)
X-ray tube voltage: 40.0 kV
X-ray tube current: 400.0 mA
Sampling width: 0.010 deg
Scanning speed: 4.000 deg/minute
Divergence slit: 1.00 deg
Scattering slit: 1.00 deg
Photoreceptive slit: 0.30 mm FIG. 8 is a graph showing an X-ray diffraction spectrum obtained with respect to the measurement sample. Referring to FIG. 8, peak $P_{S1}$ to $P_{S3}$ were identified as caused from the silicon crystal powder, which was added as the internal standard. Peak $P_g$ was identified as caused from the graphite. It was supposed that the graphite came from the graphite electrodes used in the above (1). Further, it was confirmed that, in a region R of 2θ<about 28°, a broad distributions, which significantly exceeds the background level in the region of 2θ>30° and forms a non-peak shape, were included in overlapping with Peak $P_g$.

Figure 9:
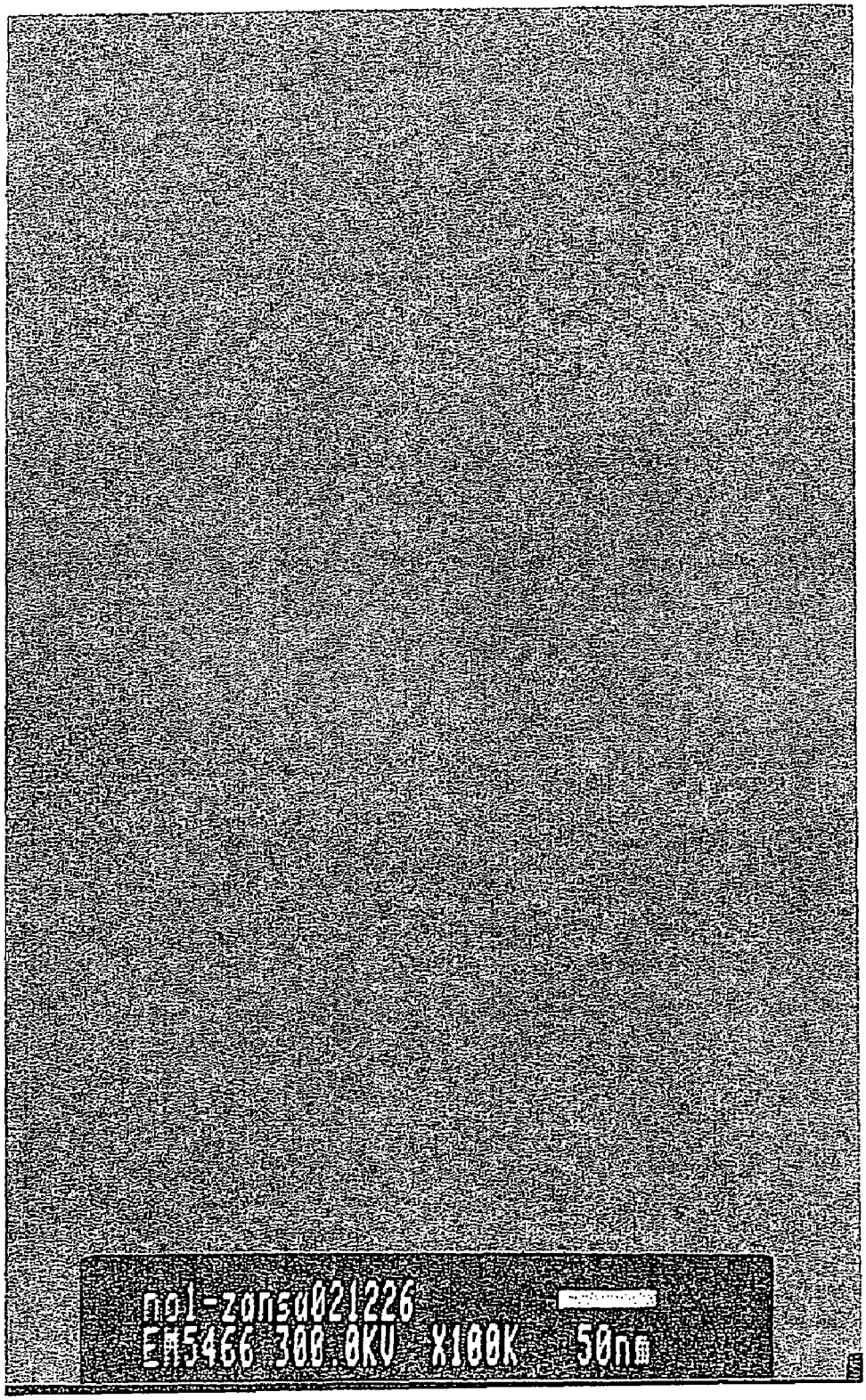
FIG. 9 is a TEM photograph of a powder sample of a fullerene residual.

Next, a powder sample of the fullerene residual is observed by means of TEM. FIG. 9 is a TEM photograph of the powder sample of the fullerenes residual. From the TEM photograph also, it was confirmed that the fullerene residual was a substantially noncrystal and amorphous material. Further, it was understood that peak $P_g$ in the X-ray diffraction spectrum in FIG. 8 came from the graphite electrodes.

Furthermore, the atoms in the powder sample of the recovered soot including the fullerenes before filtering and the elements in the powder sample of the fullerene residual were analyzed. Table 1 shows the result of the analysis.

Analyzed elements: oxygen and hydrogen
Analyzer: oxygen and nitrogen analyzer (TC600 manufactured by LECO), hydrogen analyzer (EMGA621 manufactured by Horiba)
Working curve: (1) working curve for determining the quantity of the oxygen was created using 001-106 (concentration of oxygen atom=1090±20 ppm, approximately 0.8 g) prepared by Japan Analyst, and 001-103 (concentration of oxygen atom=172±6 ppm, concentration of nitrogen atom=58±2 ppm, approximately 1 g) as a standard sample for oxygen. (2) Working curve for determining the quantity of the hydrogen was created using AR556 (concentration of hydrogen atom=6.24±0.6 ppm) prepared by ALPHA as a standard sample of hydrogen.

Preprocessing: Before measurement, each powder sample is heated at 130° C. for 1 hour or more.

TABLE 1

| Sample | Number | Result of Oxygen (O) analysis Mass (g) | Content ratio (mass %) | Result of Hydrogen (H) analysis Mass (g) | Content ratio (mass %) | Mole ratio O/H(-) |
|---|---|---|---|---|---|---|
| Recovered soot before fullerene extraction | 1 | 0.0019 | 3.56 | 0.0022 | 0.162 | 1.15 |
| | 2 | 0.0016 | 3.61 | 0.0017 | 0.164 | 1.16 |
| | 3 | 0.0015 | 3.29 | 0.0017 | 0.148 | 1.17 |
| | 4 | 0.0011 | 3.51 | — | — | — |
| | Average value | 0.0015 | 3.49 | 0.0019 | 0.158 | 1.16 |
| | Dispersion | 0.0008 | 0.32 | 0.0005 | 0.016 | 0.02 |
| Fullerene residual | 1 | 0.0051 | 10.7 | 0.0013 | 0.510 | 1.10 |
| | 2 | 0.0063 | 10.8 | 0.0011 | 0.477 | 1.20 |
| | 3 | 0.0064 | 10.7 | 0.0016 | 0.296 | 1.89 |
| | Average value | 0.0059 | 10.7 | 0.0013 | 0.428 | 1.32 |
| | Dispersion | 0.0013 | 0.2 | 0.0005 | 0.214 | 0.79 |

Furthermore, it was attempted to extract fullerenes from the fullerene residual, and fullerenes of approximately 200 ppm was extracted. Contrarily, the extraction ratio of the fullerenes from the recovered soot was approximately 7 mass %. When the $C_{60}/C_{70}$ ratio in the fullerenes extracted from the both samples was measured, in the fullerenes extracted from the soot, the $C_{60}/C_{70}$ ratio was approximately 5; in the fullerenes extracted from the fullerene residual, the $C_{60}/C_{70}$ ratio was approximately 1.

Further, as a result of the measurement of the tap density of the power sample of the recovered soot and the powder sample of the fullerene residual, in the powder sample of the recovered soot, the value was 70.035 g/cm$^3$; in the powder sample of the fullerene residual, the value was 0.25 g/cm$^3$.

(3) Manufacturing of the Electric Device 1 and Evaluation of the Characteristics Thereof.

Using the fullerene residual obtained in the above (1) as the electric conductor, each electric devices 1, 1 having the conductive member 41, 42 were formed in the same manner as the above [first manufacturing method] and [second manufacturing method]. With respect to these electric devices 1, 1, the temperature-resistance characteristics were measured. As a result, it was confirmed that the temperature-resistance curve showing sharp changes of resistance within a narrow temperature range same as the curve L2 shown in FIG. 7 was obtained.

INDUSTRIAL APPLICABILITY

According to the conductive member and the electric device in accordance with the present invention, the operation characteristics to cause the resistance to change sharply within a narrow operation temperature range can be obtained. Also, according to the manufacturing method of the conductive member and the manufacturing method of the electric device in accordance with the present invention, the conductive member and the electric device, which provide such superior temperature-resistance characteristics, can be manufactured in accordance with extremely simple processing steps.

The invention claimed is:

1. A conductive member comprising a resin including an electric conductor, wherein the electric conductor consists of a residual material of a synthetic carbonaceous material including fullerenes generated in the preparation process of fullerenes from which at least a part of the fullerenes is removed, and wherein, the fullerenes concentration of the residual material is 0.5 ppm to 10 mass %, the $C_{60}/C_{70}$ ratio of the fullerenes is 0.1 to 3, and wherein a plurality of conductor particles having resin particles formed from the resin and a conductive layer formed on the surface of the resin particles and formed from the electric conductor are piled up.

2. The conductive member according to claim 1, wherein the synthetic carbonaceous material including the fullerenes is generated via a predetermined arc discharging method or a predetermined combustion method.

3. The conductive member according to claim 1, wherein the electric conductor includes oxygen atoms of 0.5 to 30 mass % and hydrogen atoms of 0.05 to 1 mass %.

4. An electric device having a conductive member including a resin and an electric conductor, comprising:

an electrode couple; and a conductive member, which is provided between the electrodes constituting the electrode couple and formed from a resin including an electric conductor, wherein the electric conductor consists of a residual material of a synthetic carbonaceous material including fullerenes generated in the preparation process of fullerenes from which at least a part of the fullerenes is removed, and wherein the fullerenes concentration of the residual material is 0.5 ppm to 10 mass %, the $C_{60}/C_{70}$ ratio of the fullerenes is 0.1 to 3, and wherein a plurality of conductor particles having resin particles formed from the resin and a conductive layer formed on the surface of the resin particles and formed from the electric conductor are piled up.

5. The electric device according to claim 4, wherein the synthetic carbonaceous material including the fullerenes is generated via a predetermined arc discharging method or a predetermined combustion method.

6. The electric device according to claim 4, wherein the electric conductor includes oxygen atoms of 0.5 to 30 mass % and hydrogen atoms of 0.05 to 1 mass %.

* * * * *